US008591202B2

(12) United States Patent
Lack et al.

(10) Patent No.: US 8,591,202 B2
(45) Date of Patent: Nov. 26, 2013

(54) POSITIVE DISPLACEMENT PUMPING SYSTEM

(76) Inventors: Larry Lack, Glendale, AZ (US); Patricia Lack, Glendale, AZ (US); Larry Lack, legal representative, Glendale, AZ (US)

( * ) Notice: Subject to any disclaimer, the term of this patent is extended or adjusted under 35 U.S.C. 154(b) by 792 days.

(21) Appl. No.: 12/482,015

(22) Filed: Jun. 10, 2009

(65) Prior Publication Data

US 2010/0316504 A1 Dec. 16, 2010

(51) Int. Cl.
*F04B 35/04* (2006.01)
*F04B 17/04* (2006.01)

(52) U.S. Cl.
USPC ..... 417/418

(58) Field of Classification Search
USPC ..... 417/53, 254, 267, 268, 418, 419, 458, 417/487, 488, 547, 555.2, 557, 569, 570, 417/571, 495, 523, 259, 404; 166/105, 108, 166/109, 110, 369
See application file for complete search history.

(56) References Cited

U.S. PATENT DOCUMENTS

| | | | | | |
|---|---|---|---|---|---|
| 2,049,391 | A * | 7/1936 | Gee | 417/487 |
| 2,175,947 | A * | 10/1939 | Teeple | 417/469 |
| 2,190,535 | A * | 2/1940 | Robertson | 417/91 |
| 2,245,501 | A * | 6/1941 | Richardson | 417/403 |
| 2,580,331 | A * | 12/1951 | Teetor | 166/68.5 |
| 2,806,429 | A | 9/1957 | Anderson | |
| 2,933,046 | A | 4/1960 | Furrer | |
| 3,274,900 | A | 9/1966 | Hough | |
| 3,782,222 | A | 1/1974 | Berggren | |
| 4,084,923 | A | 4/1978 | Roeder | |
| 4,211,126 | A | 7/1980 | Sutz | |
| 4,249,867 | A * | 2/1981 | Cunningham | 417/334 |
| 5,196,770 | A | 3/1993 | Champs | |
| 5,807,078 | A * | 9/1998 | Chen | 417/262 |
| 5,873,411 | A | 2/1999 | Prentiss | |
| 6,863,505 | B2 | 3/2005 | Dietz | |
| 2006/0024171 | A1 | 2/2006 | Smith | |
| 2006/0024177 | A1 | 2/2006 | Robison | |

FOREIGN PATENT DOCUMENTS

| | | |
|---|---|---|
| GB | 1514995 | 6/1978 |

* cited by examiner

*Primary Examiner* — Charles Freay
*Assistant Examiner* — Amene Bayou
(74) *Attorney, Agent, or Firm* — Etherton Law Group, LLC

(57) ABSTRACT

A positive displacement pumping system for use in deep wells includes a drive system and one or two pumps. The drive system may include an electrical motor or a windmill. The pump include a central hollow discharge tube and one or more vertically aligned pumping chambers in fluid communication with the central discharge tube. Within each pumping chamber, a valve arrangement, which includes a piston or shuttle member and fluid intakes, causes fluid to fill and then drain from the pumping chambers as the central hollow discharge tube reciprocates. In operation, the drive system causes the central hollow discharge tube in the pump to reciprocate and thereby cause the fluid to travel from each pumping chamber into to the central discharge tube. In the preferred embodiment, fluid is pumped on both the upstroke and downstroke of the central discharge tube.

1 Claim, 11 Drawing Sheets

9a
9
8
7a
18
17
22
23
19
7b
15
14
20
21
16
13
12
5
4
2

POSITIVE DISPLACEMENT PUMPING SYSTEM

FIELD OF INVENTION

This invention relates to pumping systems and methods of pumping fluids such as water and oil. More particularly, this invention relates to a positive displacement pumping system for deep-water wells.

BACKGROUND

In many agricultural regions, deep-water wells are heavily relied upon to provide the water necessary to irrigate crops. In large-scale operations, these deep-water wells, which may be 1200-1300 feet deep, supply large volumes of ground water to the surface through deep well pumping systems. Currently available systems, however, suffer from one or more drawbacks that increase operation and maintenance costs.

Traditionally, for large-scale deep-water wells, centrifugal pumps have been installed. A centrifugal pump is a rotodynamic pump that uses a rotating impeller to increase the velocity of a fluid. Generally, one or more cascaded multi-stage impeller pumps, or "bowls" as the stages are commonly called, have been used for approximately every 70 feet of well depth. Accordingly, a well that is 500 feet deep requires at least seven bowls situated at the well bottom to be effective. These pump systems are driven either by a large down hole submersible electric motor or by a complex mechanical drive from the surface. The latter is typically powered either by a vertically oriented electric motor or by a gasoline or natural gas engine driving through a speed reducer gearbox and a ninety-degree drive.

Centrifugal pumps have several drawbacks, however. For example, centrifugal pumps are driven at about 1750 rpm such that, with an eight-inch pump as is commonly used, the impeller tip speed moves in excess of 42 miles per hour. As a result, even small grains of sand or other contaminants can cause rapid wear or even catastrophic failure. Another drawback of centrifugal pumps is that they must continuously maintain a certain minimum rpm before they will pump any liquid at all. A typical centrifugal pump designed for deep well water use will cease pumping altogether if its rotational speed falls below about 1550 rpm. A further drawback of centrifugal pumps is that their speed cannot be controlled as needed. It would be desirable to have a pumping system that can pump, for example, at anywhere from 500 rpm to 1800 rpm as needed.

Maintaining centrifugal pump systems can also be time consuming and expensive. For example, for a centrifugal pump system placed in a 600 foot deep well and powered by an electric motor, electric costs can be over $5500 per month. For the same size well, using an internal combustion engine to power the pump requires daily maintenance and about $4000 in fuel each month. Additionally, periodic overhauls of the internal combustion engine cost approximately $3000. It would be desirable to use instead a more cost effective and lower maintenance pump, such as a positive displacement pump, for large-scale deep-water well applications.

Positive displacement pumps have not been traditionally used for deep-water well applications because deep wells require too large of a pump. Positive displacement pumps include piston pumps, sucker pumps, and plunger pumps. For example, plunger pumps generally use mechanical or electrical energy to raise and lower a reciprocating plunger in a cylinder. As the plunger is forced to the bottom of the cylinder, the plunger collapses and allows a fixed amount of fluid to move from the bottom of the cylinder to the area above the plunger. The plunger is then pulled out toward the top end of the cylinder and consequently draws fluid in the bottom of the cylinder below the plunger. The plunger forces the fluid above it to flow upwards through the cylinder and well bore to a discharge field or zone. Generally, the amount of water discharged is dependent on the stroke length of the pump. It would be desirable to develop a pump where the amount of water discharged is not limited by the stroke length of the pump.

Another drawback to positive displacement pumps for use in deep underground aquifers is that a long vertical cylinder must be used. While in shallower applications, the momentum of the fluid is sufficient to carry it out of the well bore, in deeper applications, the momentum may be insufficient. Consequently, the fluid will not be pumped out of the well bore because the piston cannot lift the weight of the fluid in the cylinder and that above it. In general, pumps have to be designed taking into account the head pressure. Head pressure is the amount of pressure due to static and dynamic fluids sitting above the pump. The static head pressure relates to the elevation of the fluid above the pump, and the dynamic head pressure relates to the velocity of the fluid above the pump. Bernoulli's equation for determining head pressure is H=static pressure head+dynamic head+elevation or $$H=p/dg+v^2/2g+y$$

where p is pressure in $lb/in^2$ or kPA; d is density in $lb/ft^3$ or kg/I; v is velocity in ft/sec or m/sec; g is gravity (32.2 $ft/sec^2$ or 9.8 $m/sec^2$); and y is elevation in ft or m. Accordingly, it would be desirable to provide a high capacity positive displacement pump that eliminates or significantly reduces the head pressure so that fluid can be efficiently and cost-effectively drawn from deep wells and underground aquifers. It would also be desirable to provide an efficient high capacity positive displacement pump that can remain in service for long periods of time without significant maintenance and that is fueled by alternative energy sources.

Therefore, it is an object of this invention to provide a positive displacement pumping system for use in deep wells that is not limited by the stroke length of the pump. It is a further object of this invention to provide a positive displacement pumping system with significantly reduced head pressure. Another object of this invention is to provide a positive displacement pumping system that requires little or no maintenance after installation. It is also an object of this invention to provide a positive displacement pumping system that can be powered by solar or wind power. A further object of this invention is to provide a positive displacement pumping system where speed can be controlled or slowed down as needed.

SUMMARY OF THE INVENTION

The present invention is a positive displacement pumping system for use in deep wells. The pumping system includes a drive system and one or two pumps. In the preferred embodiment, the drive system includes an electrical motor, a speed reducer, and a rotary-to-reciprocal motion converter. In alternative embodiments, the drive system includes a windmill and a variable transmission. Where one pump is used with a windmill, a counterbalance can be included in the drive system. Preferably, however, two pumps are used side-by-side eliminating the need for a counterbalance and effectively reducing head pressure.

The pumps include a central hollow discharge tube and one or more vertically aligned pumping chambers in fluid communication with the central discharge tube. Within each pumping chamber, a valve arrangement comprising preferably a piston and fluid intakes causes fluid to fill and then drain from the pumping chambers as the central hollow discharge tube reciprocates. In operation, the drive system causes the central hollow discharge tube in the pump to reciprocate and thereby cause the fluid to travel from each pumping chamber into to the central discharge tube. In the preferred embodiment, fluid is pumped on both the upstroke and downstroke of the central discharge tube. Alternatively, fluid is discharged on only the upstroke. Fluid from the central discharge tube is discharged from the pump into the discharge field. The amount of fluid discharged on each stroke depends on the number of pumping chambers, the size of the pumping chambers, and the length of the stroke. A greater number of pumping chambers causes a greater discharge of fluid at a higher velocity into the discharge field.

DETAILED DESCRIPTION OF THE INVENTION

Figure 1A:
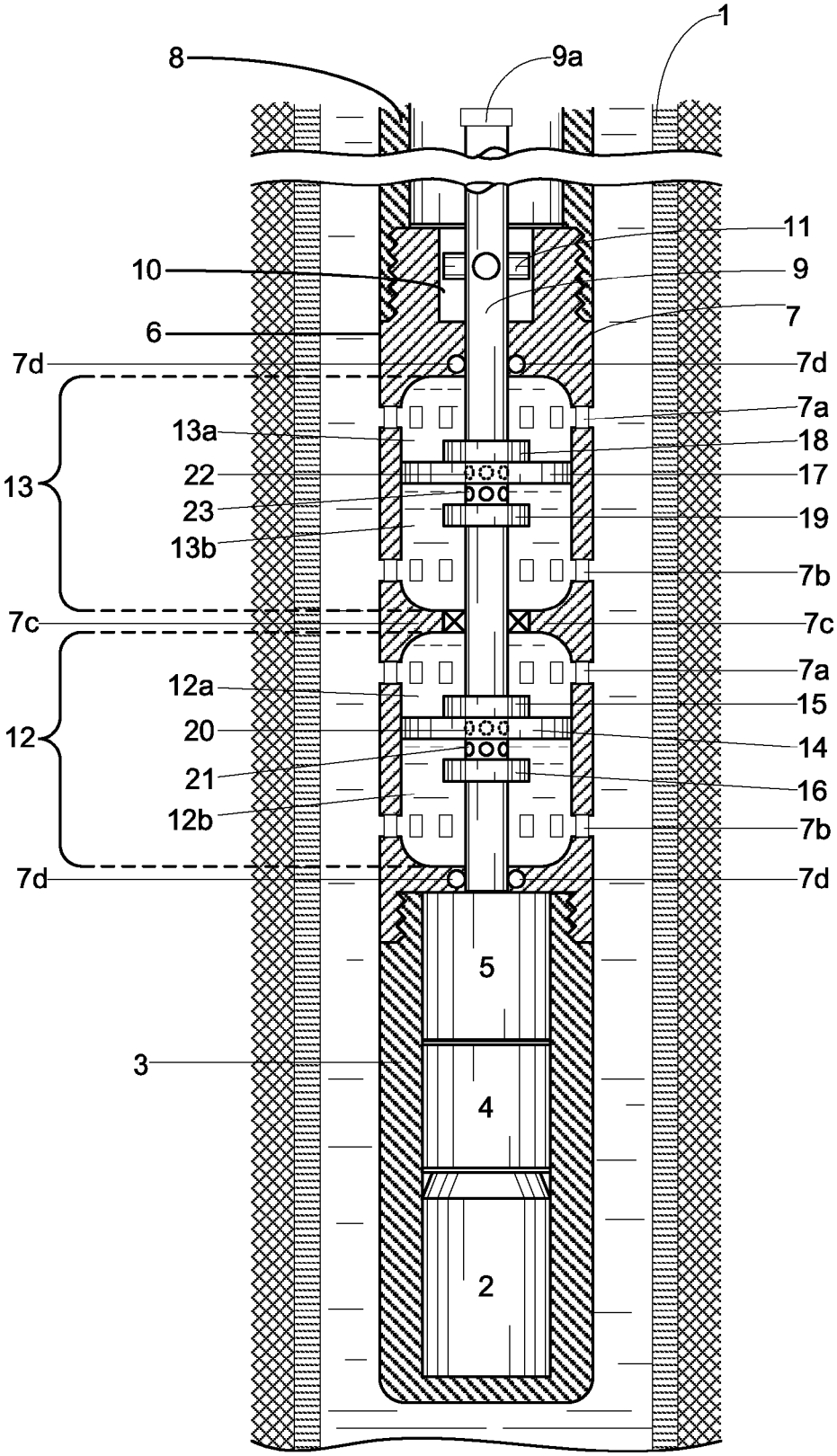
FIG. 1*a* is a partial cutaway view of the preferred embodiment of a pump with multiple pumping chambers.

FIG. 1*a* illustrates the preferred embodiment of the present invention, a positive displacement pumping system for pumping fluids such as water or oil from deep wells. FIG. 1*a* shows the pumping system submersed in a deep well bore having a casing or wall 1. In general, the pumping system comprises a drive system that causes one or more pumps to reciprocate. In the preferred embodiment, the drive system comprises a motor 2, a speed reducer 4, and a rotary-to-reciprocal motion converter 5. Motion converter 5 connects to pump 6. Motor 2 is situated in a waterproof housing 3 and produces a rotary output directed to an input (not shown) of speed reducer 4. Speed reducer 4, which will be discussed in detail with reference to FIGS. 6*a*-6*c*, comprises several stages of planetary reduction gears. Preferably, the nominal speed of motor 2 is 1800 rpm and speed reducer 4 is configured to effect a thirty-to-one reduction for an output of 60 rpm. The output of speed reducer 4 is applied to the input (not shown) of motion converter 5. Motion converter 5, which will be discussed in detail with reference to FIGS. 7*a*-7*b*, converts rotary motion to reciprocating motion. The output of motion converter 5 preferably reciprocates upwardly and downwardly at a rate of one full cycle per second and is connected to a central discharge tube 9 of pump 6.

Pump 6 comprises a housing 7, preferably cylindrical, that defines two or more vertically aligned pumping chambers. The number of pumping chambers depends upon the required volume of fluid delivery desired. FIG. 1*a* illustrates a pump having a first pumping chamber 12 and a second pumping chamber 13. The chambers are defined by housing 7 and annular flanges 7*c* that extend inward toward central discharge tube 9. While only two pumping chambers are shown, any number of pumping chambers can be used without changing the operation of the pump, as will be known to someone skilled in the art. Pumping chambers 12 and 13 are vertically aligned and are in fluid communication with the well through a plurality of upper check valves 7*a* and a plurality of lower check valves 7*b* arranged around the circumference of pump housing 7. Pumping chambers 12 and 13 are also in fluid communication with central discharge tube 9 through pluralities of intake apertures 20, 21, 22, and 23 defined by central discharge tube 9. Fluid is drawn into the pumping chambers from the fluid source and pushed out of the pumping chambers into central discharge tube 9 through operation in each pumping chamber 12 and 13 of shuttle valve assemblies comprising vertically reciprocating pistons 14 and 17 that open and close the intake apertures 20, 21, 22, and 23. Fluid then exits central discharge tube 9 through a check valve 9*a* into a pump discharge pipe 8. Discharge pipe 8 is in fluid communication with a discharge field (not shown) where fluid collects after it has been pumped from the well. Check valve 9*a* serves to eliminate small quantities of reverse downward flow of fluid during valve assembly position changes.

Each pumping chamber 12 and 13 comprises an upper sub-chamber 12*a* and 13*a* respectively and a lower sub-chamber 12*b* and 13*b* respectively. Upper sub-chamber 12*a* and lower sub-chamber 12*b* are separated by first piston 14, and upper sub-chamber 13*a* and lower sub-chamber 13*b* are separated by second piston 17. Additional chambers would include identical features. Accordingly, pistons 14 and 17 each must be sized with an outer perimeter that slidably and sealably engages the interior walls of the pumping chambers and an inner diameter that slidably and sealably engages the central discharge tube so that each piston divides a pumping chamber into upper and lower sub-chambers. As shown in FIG. 1*a*, first piston 14 surrounds central discharge tube 9 and translates along central discharge tube 9 between first upper arresting member 15 and first lower arresting member 16. Second piston 17 also surrounds central discharge tube 9 and translates along central discharge tube 9 between second upper arresting member 18 and second lower arresting member 19. First and second upper arresting members 15 and 18 and first and second lower arresting members 16 and 19 are fixed to central discharge tube 9. The upper and lower arresting members may comprise annular rings, pins, blocks, or any other feature capable of stopping the pistons from sliding further along central discharge tube 9. In the preferred embodiment, each arresting member is an annular ring completely surrounding central discharge tube 9 and extends slightly into the pumping chambers.

Central discharge tube 9 defines several series of intake apertures that draw fluid from the chambers into central discharge tube. A first plurality of upper intake apertures 20 facilitates fluid communication between central discharge tube 9 and first upper sub-chamber 12*a*. The first plurality of upper intake apertures 20 is closed when piston 14 engages first upper arresting member 15. A first plurality of lower intake apertures 21 facilitates fluid communication between central discharge tube 9 and first lower sub-chamber 12*b*. First plurality of lower intake apertures 21 are closed when piston 14 engages first lower arresting member 16. Similarly, a second plurality of upper intake apertures 22 facilitates fluid communication between central discharge tube 9 and second upper sub-chamber 13*a*. The second plurality of upper intake apertures 22 is closed when second piston 17 engages second upper arresting member 18. A second plurality of lower intake apertures 23 facilitates fluid communication between central discharge tube 9 and second lower sub-chamber 13*b*. The second plurality of lower intake apertures 23 is closed when second piston 17 engages second lower arresting member 19.

Pump 6 also includes a plurality of seals 7d and an optional alignment block for additional control of the movement of central discharge tube 9. Seals 7*d* permit the vertical reciprocating motion of the discharge tube 9 in the region of pump 6 while inhibiting the free flow of fluid across the sealed junctions. The optional alignment block includes longitudinal grooves 10 that cooperate with pins 11 radially extending from central discharge tube 9. The grooves are designed to only permit reciprocal motion and to prevent rotation of the central discharge tube 9. Pins 11 travel only vertically within grooves 10. Other physical methods of preventing rotation and of sealing junctions can be used as well, as is known in the art. Those skilled in the art will also understand that the alignment block can be incorporated at any convenient position along central discharge tube 9.

Figures 1B, 1C:
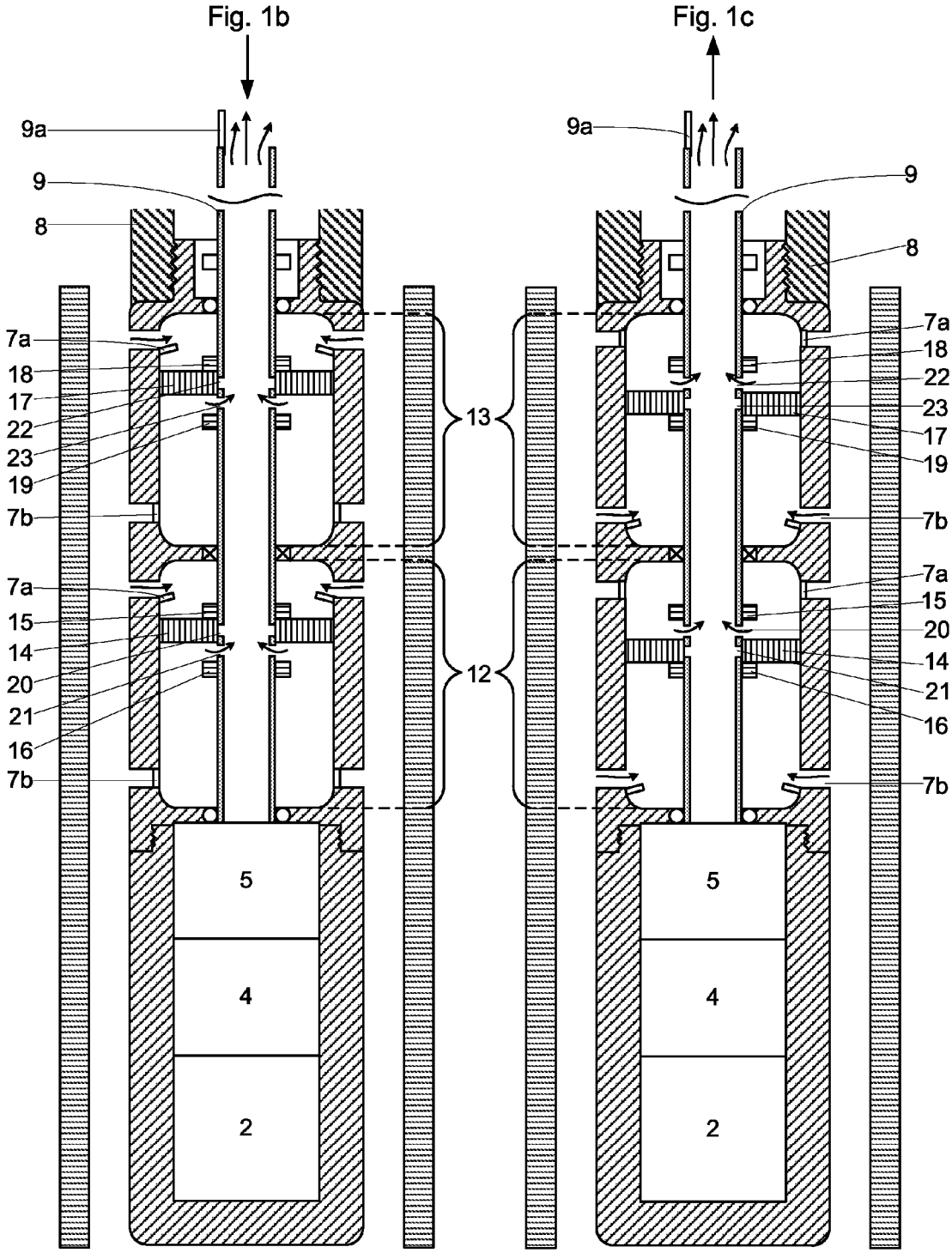
FIG. 1*b* is a cutaway view of the preferred embodiment of the pump during a downstroke.
FIG. 1*c* is a cutaway view of the preferred embodiment of the pump during an upstroke.

FIGS. 1*b* and 1*c* illustrate how fluid travels through chambers 12 and 13 and central discharge tube 9 as pump 6 operates. FIG. 1*b* shows pump 6 at the beginning of a downstroke. During a downstroke, the pressure differences existent between the upper and lower sub-chambers force first piston 14 to press against or engage first upper arresting member 15 so that first upper intake apertures 20 are closed and first lower intake apertures 21 are exposed. Similarly, second piston 17 engages second upper arresting member 18 so that second upper intake apertures 22 are closed and second lower intake apertures 23 are exposed. The pressure differences also cause a plurality of lower chamber check valves 7*b* located in lower sub-chambers 12*b* and 13*b* to be closed and a plurality of upper chamber check valves 7*a* located in upper sub-chambers 12*a* and 13*a* to be open. As central discharge tube 9 reciprocates downward, fluid is forced from the lower sub-chambers 12*b* and 13*b* into central discharge tube 9. Simultaneously, fluid flows from the well into upper sub-chambers 12*a* and 13*a* through upper check valves 7*a*.

FIG. 1*c* shows pump 6 at the beginning of an upstroke. During an upstroke, first piston 14 engages first lower arresting member 16 so that first upper intake apertures 20 are exposed and second lower intake apertures 21 are closed. Similarly, second piston 17 engages second lower arresting member 19 so that second upper intake apertures 22 are exposed and second lower intake apertures 23 are closed. The lower chamber check valves 7*b* are open, and the upper chamber check valves 7*a* are closed due to pressure differences. As central discharge tube 9 reciprocates upward, fluid is forced from the upper sub-chambers 12*a* and 13*a* into central discharge tube 9. Simultaneously, fluid flows from the well into lower sub-chambers 12*b* and 13*b* through lower check valves 7*b*.

In operation, as central discharge tube 9 reciprocates, fluid is being forced from either the upper sub-chambers or lower sub-chambers into the central discharge tube and then out of the central discharge tube into first a discharge pipe 8 and eventually the discharge field. On every upstroke or downstroke, the amount of fluid pumped out of the well is dependent on the number of pumping chambers, the size of the pumping chambers, and the length of the stroke. By using several smaller pumping chambers instead of one large pumping chamber, the length of stroke can be reduced. Consequently, a large volume of fluid can be pumped from a well with a small stroke.

Additional pump housing check valve arrangements, central discharge tube intake apertures, and shuttle valve assemblies can achieve the same results according to this invention as long as multiple pumping chambers are used. For example, if pump 6 was modified so that lower chamber check valves 7*b* were always open and lower intake apertures were eliminated, then pump 6 would pump fluid from the upper sub-chambers to the central discharge tube 9 during an upstroke and fill the upper sub-chambers through upper check valves 7*a* during a downstroke. Lower sub-chambers will simply allow fluid to transfer between the lower sub-chambers and the well during the upstrokes and downstrokes. Additional combinations of central discharge tube intake valves, shuttle valve assemblies, and pump housing check valves will be apparent to someone skilled in the art. Alternative combinations will also be described below.

Figure 2A:
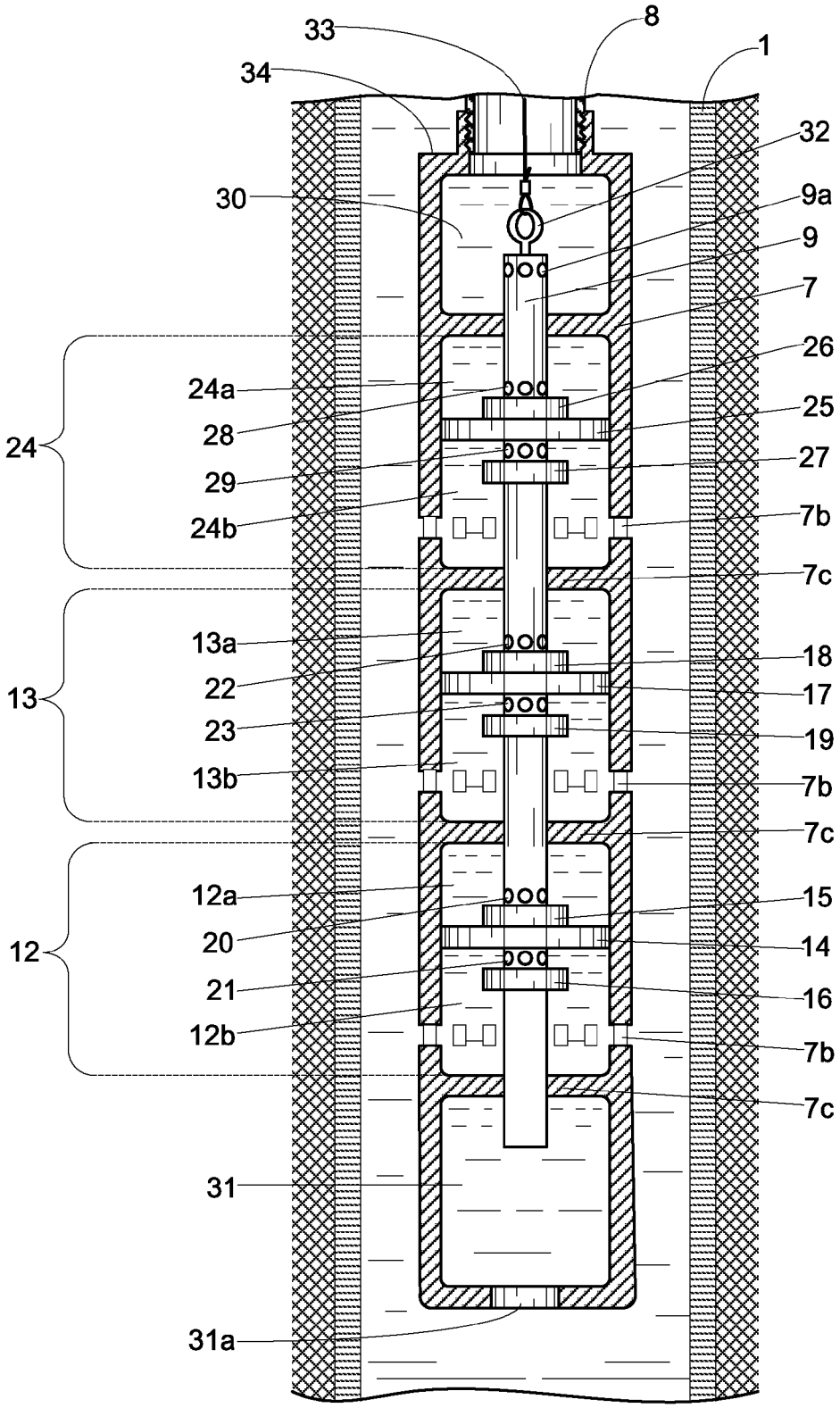
FIG. 2*a* is partial cutaway view of an alternative embodiment of a pump with multiple pumping chambers.
Figure 2D:
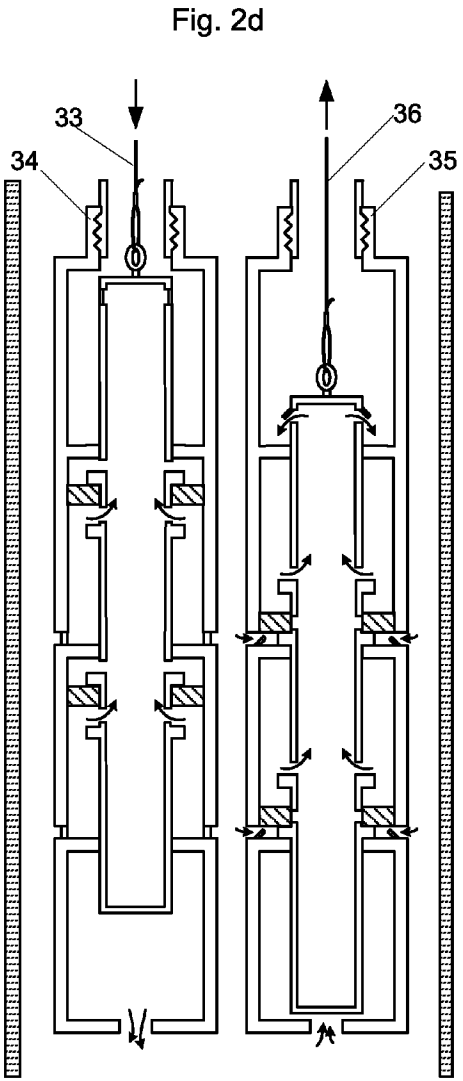
FIGS. 2*b*-2*d* are cutaway views of two pumps used together in a pumping system.
Figure 2C:
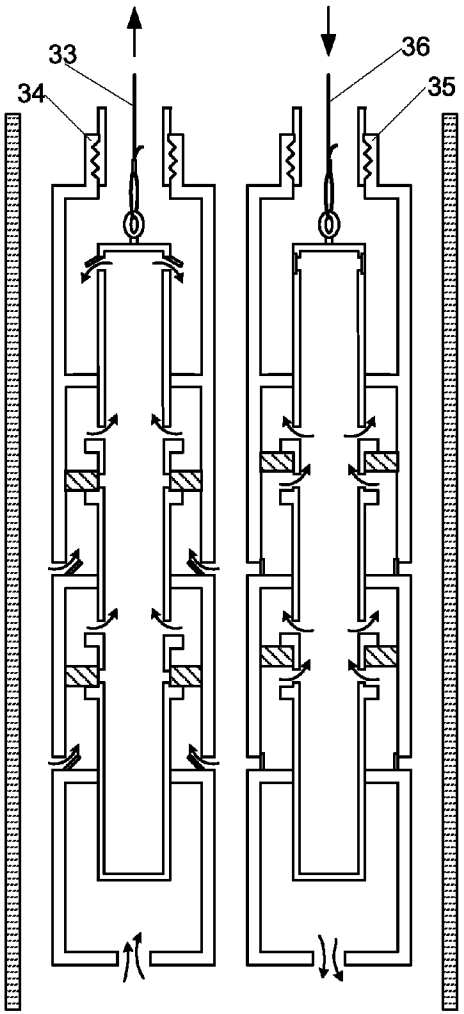
Figure 2B:
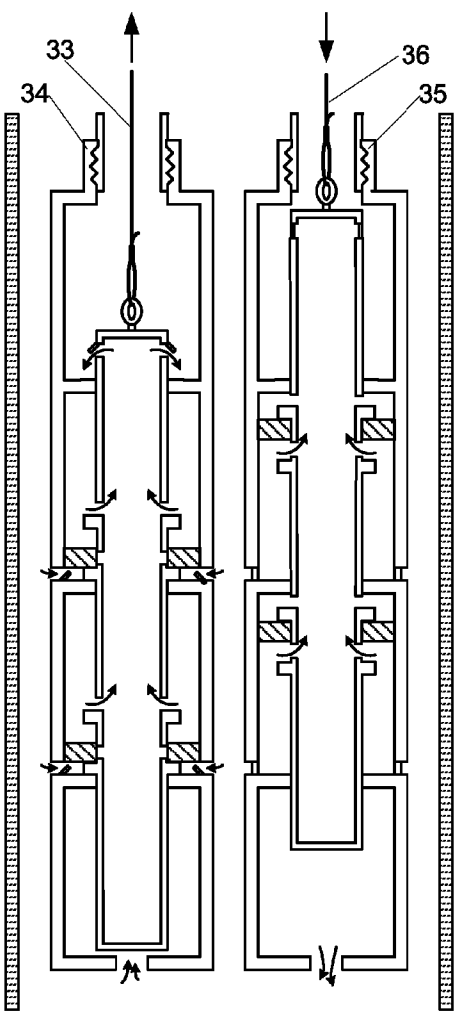

FIG. 2*a* illustrates an alternative pump embodiment. In this alternative embodiment, pump 34 cooperates with a drive system situated outside of the well. For example, pump 34 cooperates with a windmill as will be further illustrated with respect to FIGS. 8*a*-8*b*. Pump 34 can be used alone or it can be combined with an identical alternating pump for improved efficiency and reduction of head pressure. FIGS. 2*b*-2*d* illustrates a pump system using two identical alternating pumps 34 and 35.

As shown in FIG. 2*a*, pump housing 7 defines three pumping chambers 12, 13, and 24 as well as an exit chamber 30 and optional lower chamber 31. As with the preferred embodiment, any number of pumping chambers can be used depending on the desired volume of water to be pumped. Housing 7 also includes lower check valves 7*b*; however, this embodiment does not include upper check valves 7*a*. A plurality of check valves 7*b* cooperates with each pumping chamber. As shown in FIG. 2*a*, each plurality of check valves 7*b* preferably are situated uniformly about the circumference of housing 7. Exit chamber 30 is in fluid communication with the pump discharge pipe 8 that delivers the pumped fluid to the discharge field (not shown). Lower chamber 31 includes an aperture 31*a* that facilitates constant fluid communication between lower chamber 31 and the well. Lower chamber 31 protects central discharge tube 9 but is not necessary for successful operation of the pumping system.

As shown in FIG. 2*a*, central discharge tube 9 is suspended on a string 33. A loop element 32 is rigidly attached to discharge tube 9 for anchoring string 33. String 33 is raised and lowered by the external drive system (not shown). String 33 can be a cable, chain, tube, bar, or any other material useful for suspending heavy objects, as is known in the art. Likewise, any suitable attachment method can be substituted for loop element 32 depending on the material or structure suspending discharge tube 9, as is known in the art. The central discharge tube 9 is closed at its top and bottom and includes one or more check valves 9*a*. Check valves 9*a* allow fluid to exit central discharge tube 9 and enter exit chamber 30. Preferably, check valves 9*a* are situated uniformly about the circumference of central discharge tube 9. Check valves 9*a* serves to eliminate small quantities of reverse downward flow of fluid during valve assembly position changes and to allow for head pressure to be present during downstroke.

Within each pumping chamber, a piston sealably and slidably surrounds discharge tube 9 and divides the pumping chambers into upper and lower sub-chambers. As described earlier with respect to FIG. 1*a* and as shown in FIG. 2*a*, first piston 14 divides first pumping chamber 12 into first upper sub-chamber 12*a* and first lower sub-chamber 12*b*, and second piston 17 divides second pumping chamber 13 into second upper sub-chamber 13*a* and second lower sub-chamber 13*b*. First piston 14 translates between a first upper arresting member 15 and first lower arresting member 16, and second piston 17 translates between a second upper arresting member 18 and second lower arresting member 19. Likewise, a third piston 25 divides third pumping chamber 24 into a third upper sub-chamber 24*a* and third lower sub-chamber 24*b* and translates between a third upper arresting member 26 and third lower arresting member 27. The details of the piston size and shape and upper and lower arresting members size and shape are described with respect to FIG. 1*a*.

Also as described earlier with respect to FIG. 1*a* and as shown in FIG. 2*a*, central discharge tube 9 defines a first, second, and third plurality of upper intake valves 20, 22, and 28 respectively that cooperate with the first, second, and third upper sub-chambers 12*a*, 13*a*, and 24*a* respectively. Similarly, central discharge tube 9 also defines a first, second, and third plurality of lower intake apertures 21, 23, and 29 respectively that cooperate with the first, second, and third lower sub-chambers 12*b*, 13*b*, and 24*b* respectively. In this embodiment, the upper intake apertures 20, 22, and 28 respectively are situated above the upper arresting members 15, 18, and 26 respectively. Accordingly, the upper intake apertures will always remain open facilitating constant fluid communication between the upper sub-chambers 12*a*, 13*a*, and 24*a* and central discharge tube 9. In the preferred embodiment, the length of the stroke will be adjusted so the upper intake apertures will never be blocked thereby causing a fluid lock. Lower intake apertures 21, 23, and 29 are situated around discharge tube 9 between the upper and lower arresting members in each chamber, as shown in FIG. 2*a*. First lower intake apertures 21 facilitates fluid communication between first lower sub-chamber 12*b* and discharge tube 9 during the downstroke of discharge tube 9. During the upstroke of discharge tube 9, first lower intake apertures 21 will be blocked or closed by first piston 14. Second lower intake apertures 23 facilitates fluid communication between second lower sub-chamber 13*b* and discharge tube 9 during the downstroke of discharge tube 9. During the upstroke of discharge tube 9, second lower intake apertures 23 will be blocked or closed by second piston 17. Third lower intake apertures 29 facilitates fluid communication between third lower sub-chamber 24*b* and discharge tube 9 during the down stroke of discharge tube 9. During the upstroke of discharge tube 9, third lower intake apertures 29 will be blocked or closed by third piston 25.

In operation, as central discharge tube 9 reciprocates, fluid is being forced from either the upper sub-chambers or lower sub-chambers into the central discharge tube. Fluid also exits the central discharge tube into exit chamber 30 and then to discharge pipe 8 and eventually to the discharge field (not shown). In detail, during a downstroke of discharge tube 9, fluid is forced out of the lower sub-chambers, into the central discharge tube, and then into the upper sub-chambers. Check valves 9*a* are closed during a downstroke of discharge tube 9, and no fluid is expelled into exit chamber 30. In this embodiment, this is how the upper sub-chambers are filled. Then, during an upstroke of discharge tube 9, check valves 7*b* open to allow fluid to fill the lower sub-chambers. Simultaneously, lower intake valves are blocked by the pistons and fluid is forced out of the upper sub-chambers and into the central discharge tube 9. Consequently, check valves 9*a* open to allow the fluid to exit into exit chamber 30. On every upstroke, the amount of fluid pumped out of the well is dependent on the number of pumping chambers, the size of the pumping chambers, and the length of the stroke. As described above, by using several smaller pumping chambers instead of one large pumping chamber, the length of stroke can also be reduced. Consequently, a large volume of fluid can be pumped from a well with a small stroke.

FIGS. 2*b*-2*d* show a pumping system that uses two alternating and identical pumps 34 and 35 each having central discharge tubes suspended from a drive system by strings 33 and 36 respectively. In particular, FIG. 2*b* shows that when the central discharge tube of pump 34 is at the beginning of its upstroke, the central discharge tube of pump 35 is at the beginning of its downstroke. FIG. 2*c* illustrates that as the central discharge tube of pump 34 is travelling up, the central discharge tube of pump 35 is travelling down. FIG. 2*d* illustrates that when the central discharge tube of pump 34 is at the beginning of its downstroke, the central discharge tube of pump 35 is at the beginning of its upstroke. Both pumps are controlled and operated by the same drive system so that when the drive system is pulling one of the central discharge tubes up, it is simultaneously lowering the other central discharge tube. By doing so, the drive system balances the head pressure between the two pumps; the pump on downstroke carries the head pressure on the check valves, and the pump on upstroke carries the head pressure on the pistons. Additionally, fluid can be pumped out of the well twice as fast. See also the discussion below relating to FIGS. 8*a* and 8*b* for further discussion of a dual pump system and head pressure.

Figure 3A:
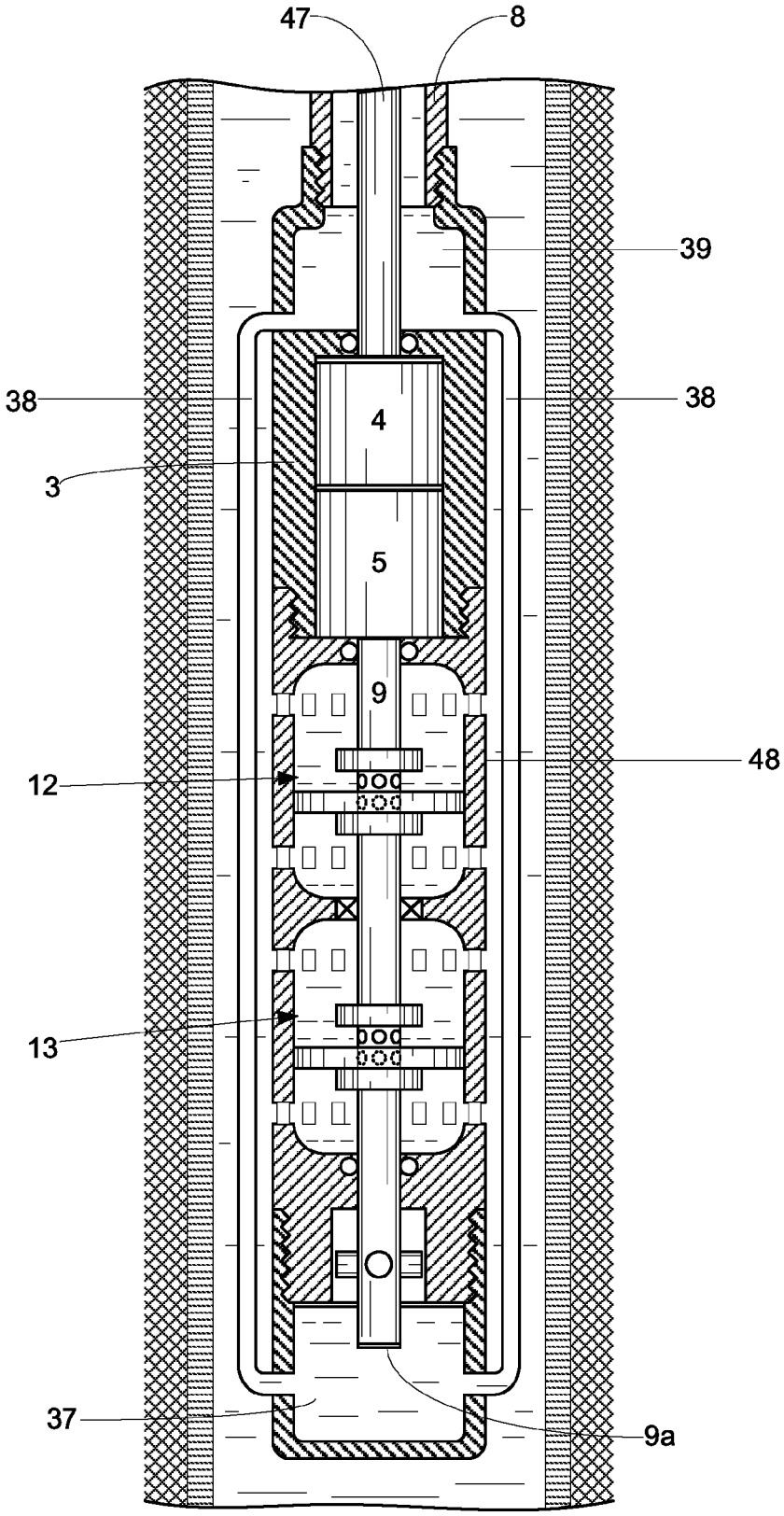
FIG. 3*a* is a partial cutaway view of a second alternative embodiment of a pump with multiple pumping chambers.

FIG. 3*a* illustrates another alternative design for the pumping system. Comparing FIG. 3*a* with FIG. 1*a*, the pumping system shown in FIG. 3*a* incorporates the same elements and functional characteristics as the pumping system shown in FIG. 1*a* except that it is inverted so that the motor (not shown), speed reducer 4, and motion converter 5 all sit above inverted pump 48. The motor sits preferably at an elevated location such as above ground level and is connected to speed reducer 4 with motor output 47. Inverted pump 48, like pump 6, includes generally cylindrical pump housing 7, waterproof housing 3, central discharge tube 9, check valve 9*a*, pumping chambers 12 and 13, upper chamber check valves 7*a*, lower chamber check valves 7*b*, alignment block grooves 10 and pins 11, pistons 14 and 17, upper arresting members 15 and 18, lower arresting members 16 and 19, upper intake apertures 20 and 22, and lower intake apertures 21 and 23. All of these references are identical to those previously discussed with respect to FIG. 1*a* except in an inverted configuration. Additionally, however, inverted pump 48 includes a lower exit chamber 37 in fluid communication with one or more fluid passageways 38 that lead to an upper exit chamber 39. Upper exit chamber 39 is in fluid communication with pump discharge pipe 8 that leads to the discharge field (not shown). When operating, the pump forces fluid from the fluid chambers into the lower exit chamber 37, which in turn pushes fluid through the passageways 38 into the upper exit chamber 39 and eventually through the discharge pipe 8 into the discharge field.

Figure 3B:
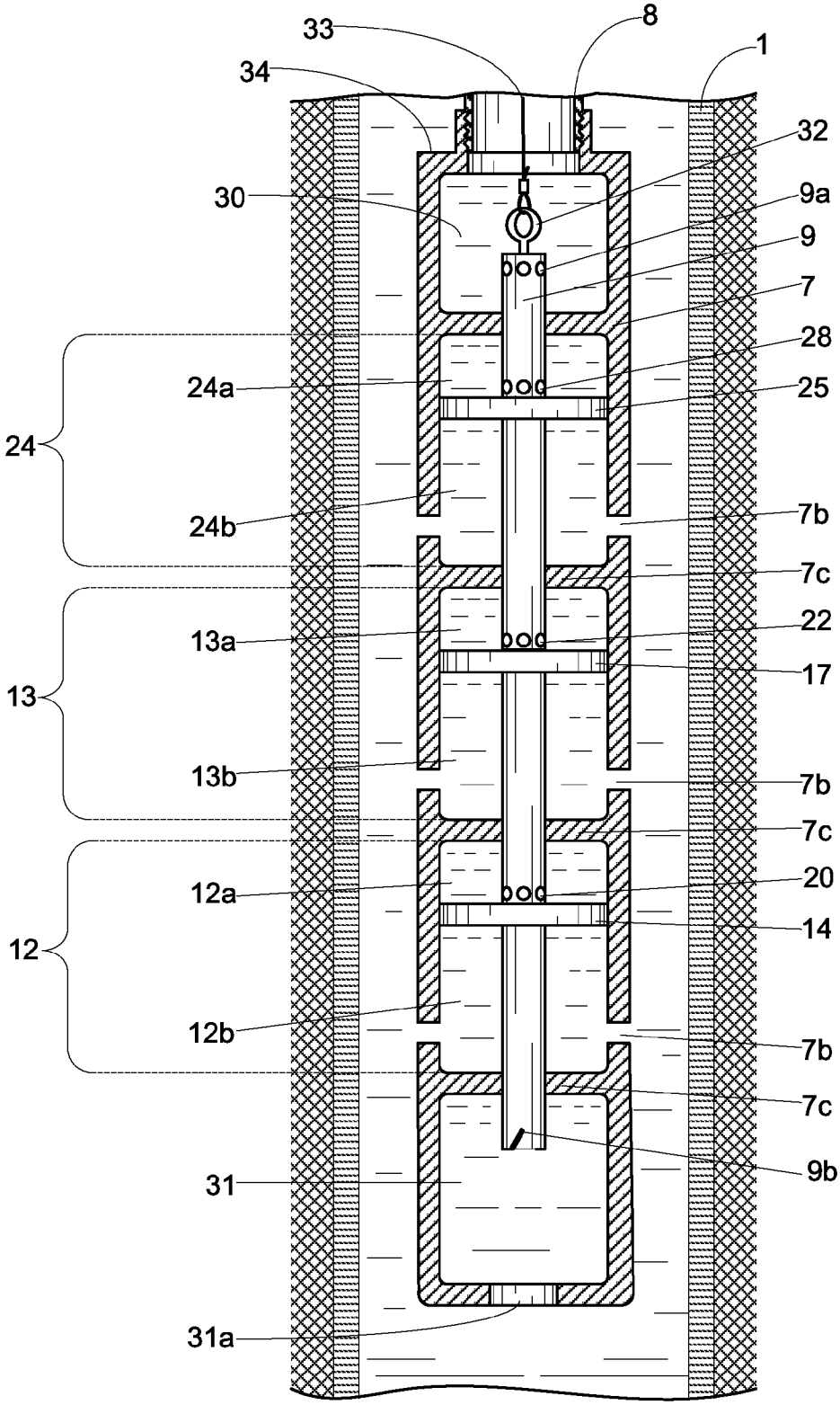
FIG. 3*b* is a partial cutaway view of a third alternative embodiment of a pump with multiple pumping chambers.

FIG. 3*b* illustrates another alternative design for the pumping system. The pumping system shown in FIG. 3*b* is a slight variation from the pumping system shown in FIG. 2*a*, and accordingly the description of FIG. 2*a* applies to this alternative as well with respect to the common elements. Comparing FIG. 3*b* with FIG. 2*a*, the pumping system shown in FIG. 3*b* is nearly identical except that the pumping system shown in FIG. 3*b* does not have upper and lower arresting members or lower intake apertures. In addition, pistons 14, 17, and 25 are all fixed to central discharge tube 9, and lower chamber check valves 7*b* are always open so that there is constant fluid communication between the lower sub-chambers 12*b*, 13*b*, and 24*b* and the well. A discharge tube check valve 9*b* is positioned on central discharge tube 9 to facilitate fluid communication between central discharge tube 9 and either lower chamber 31 or directly with the well if there is no lower chamber 31, which is detailed with respect to FIG. 2*a*. Discharge tube check valve 9*b* is closed during the upstroke and open during the downstroke of central discharge tube 9. In operation, this pumping system embodiment draws fluid into central discharge tube 9 and into upper sub-chambers 12*a*, 13*a*, and 24*a* during the downstroke of central discharge tube 9. Then, during an upstroke, discharge tube check valve 9*b* closes and pistons 14, 17, and 25 push fluid out of upper sub-chambers 12*a*, 13*a*, and 24*a* respectively, into central discharge tube 9, out central discharge tube check valves 9*a*, and into exit chamber. As is illustrated by this embodiment and previously described embodiments, intake apertures and check valves can be placed in different configurations without changing the general operation and advantage of the pumping system. Each embodiment incorporates multiple chambers from which a piston pushes fluid from the chambers and into a central discharge tube to be carried to an exit chamber. By using a reciprocating central discharge tube and multiple chambers, a greater amount of fluid can be pumped with a shorter stroke.

Figure 4B:
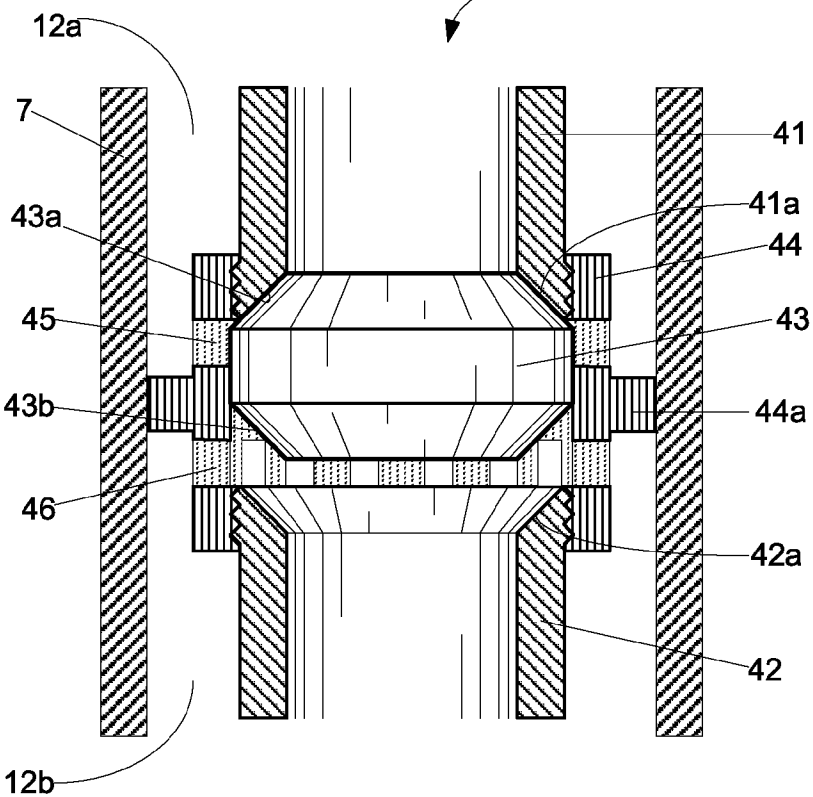
FIG. 4*b* is a partial cutaway view of the alternative shuttle valve.
Figure 4A:
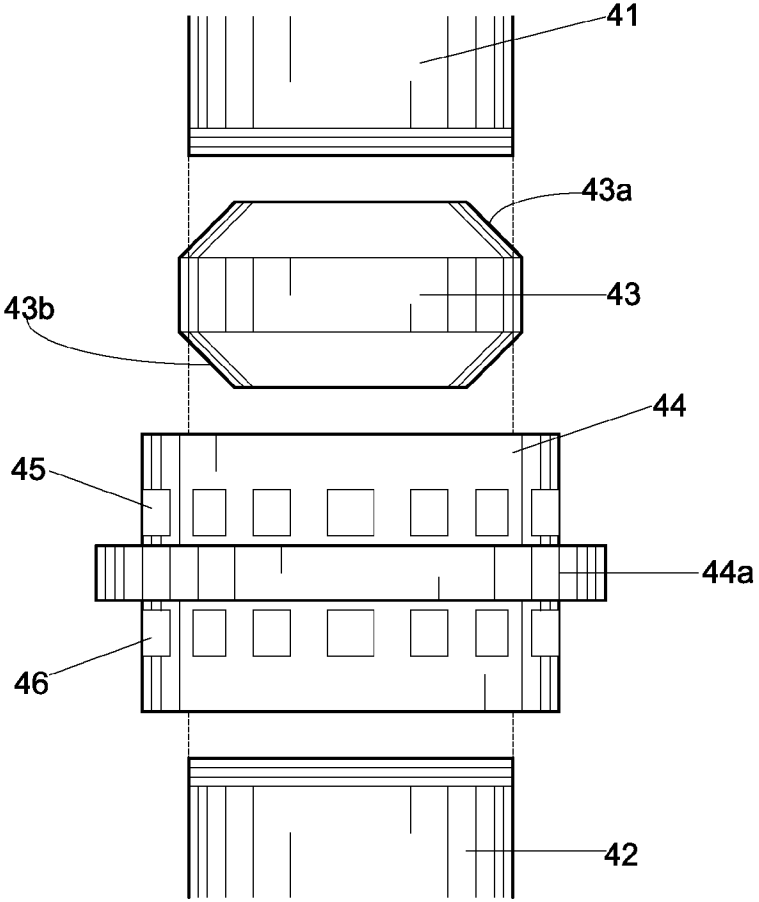
FIG. 4*a* is an exploded view of an alternative shuttle valve for use with a pump with multiple pumping chambers.

FIGS. 4*a* and 4*b* illustrate an alternative shuttle valve assembly 40 that can be used with any of the pump designs in place of the already disclosed piston valve arrangement. This alternative shuttle valve assembly substantially reduces any loss of upstroke and downstroke due to the piston. As shown in FIG. 4*a*, the shuttle valve assembly is secured between an upper tube section 41 of central discharge tube 9 and a lower tube section 42 of central discharge tube 9. Upper tube section 41 includes a beveled end wall 41*a*, and lower tube section 42 also includes a beveled end wall 42*a*. Upper tube section 41 and lower tube section 42 are both threaded externally to rigidly connect to a shuttle housing 44, although other methods of connecting the tube sections to shuttle housing 44 can be used as is known in the art. Accordingly, shuttle housing 44 is threaded on its interior surface for attachment to upper tube section and lower tube section. When upper tube section 41, shuttle housing 44, and lower tube section 42 are connected they effectively combine to form continuous central discharge tube 9. Shuttle housing 44 is generally annular and comprises a fixed piston comprising an annular flange 44*a* protruding between a plurality of upper intake apertures 45 and lower intake apertures 46 defined by shuttle housing 44. Flange 44*a* must extend far enough to slidably and sealably engage the interior wall of a pumping chamber so that it creates an upper sub-chamber and a lower sub-chamber. Upper intake apertures 45 facilitate fluid communication between the upper sub-chamber and central discharge tube 9. Lower intake apertures 46 facilitate fluid communication between the lower sub-chamber and central discharge tube 9. Disposed slidably within shuttle housing 44 is a shuttle member 43. Shuttle member 43 is also annular and has an upper beveled end wall 43*a* that compliments beveled end wall 41*a* and extends slightly into upper intake apertures 45 and a lower beveled end wall 43*b* that compliments beveled end wall 42*a* and extends slightly into lower intake apertures 46. Because beveled end walls 43*a* and 43*b* extend slightly into intake apertures 45 and 46, pressure from the fluid in the sub-chambers will force the shuttle member to translate.

Shuttle member 43 translates between a first position where upper beveled end wall 43*a* engages beveled end wall 41*a* and a second position where lower beveled end wall 43*b* engages beveled end wall 42*a*. When shuttle member 43 is in the first position, upper intake apertures 45 are blocked or closed and lower intake apertures 46 are open or exposed. When shuttle member 43 is in the second position, upper intake apertures 45 are open or exposed and lower intake apertures 46 are blocked or closed. When lower intake apertures are open, the central discharge tube 9 is in fluid communication with a lower sub-chamber of the pump. When upper intake apertures are open, the central discharge tube 9 is in fluid communication with an upper sub-chamber of the pump. The pump operates as described with respect to FIGS. 1*a*-1*c*.

Figure 5B:
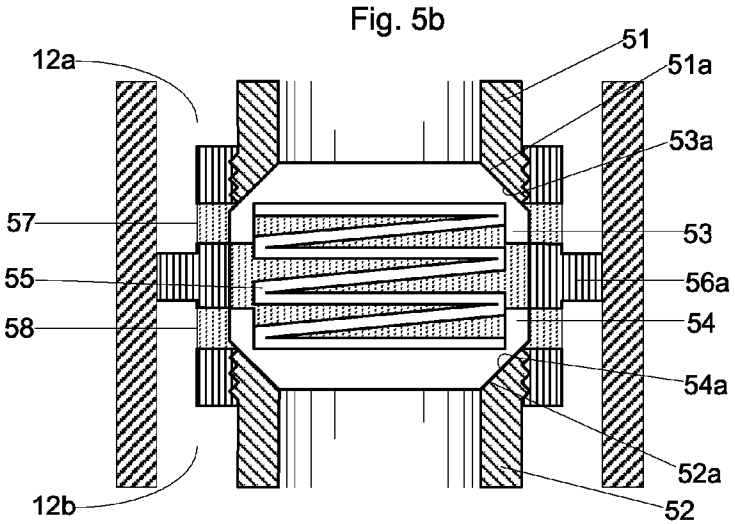
FIG. 5*b* is a partial cutaway view of the second alternative shuttle valve in a first position.
Figure 5C:
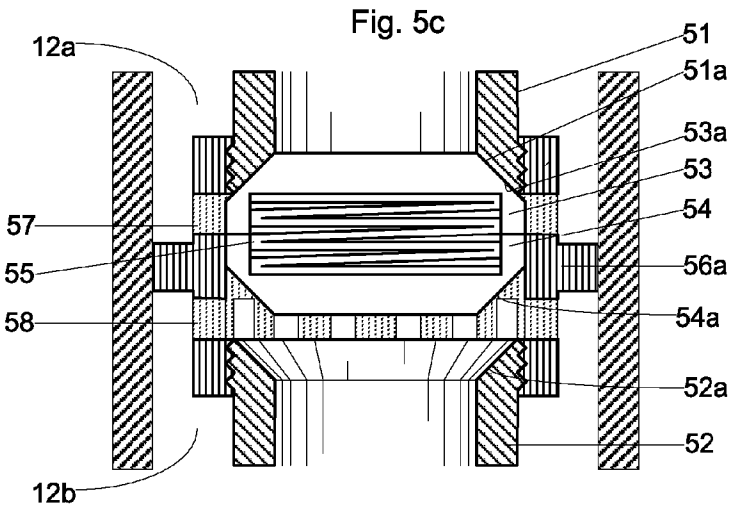
FIG. 5*c* is a partial cutaway illustration of the second alternative shuttle valve in a second position.
Figure 5A:
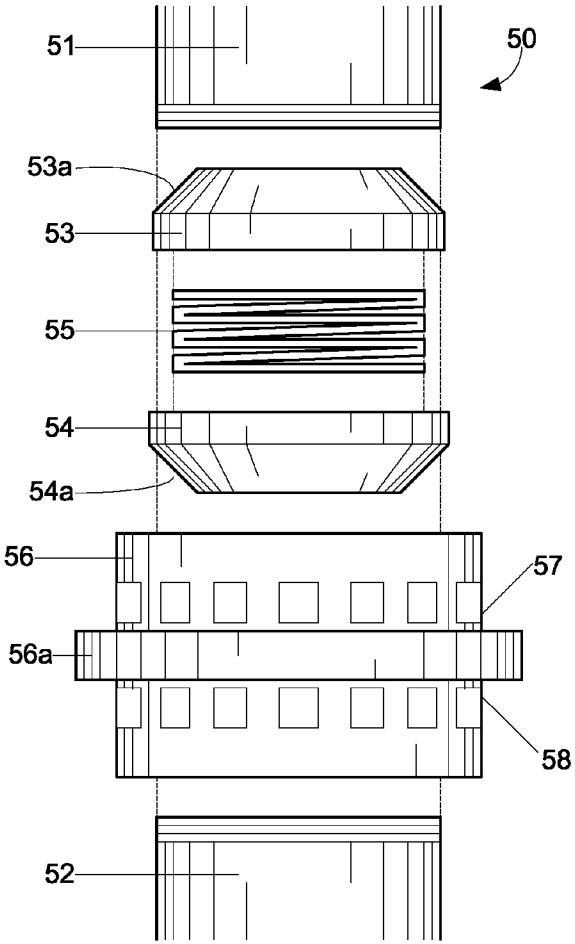
FIG. 5*a* is an exploded view of a second alternative shuttle valve for use with a pump with multiple pumping chambers.

FIGS. 5*a*-5*c* illustrate another alternative shuttle valve system 50 that can be used with any of the pump designs in place of the already disclosed piston valve arrangement. As shown in FIG. 5*a*, the shuttle valve is secured between an upper tube section 51 of central discharge tube 9 and a lower tube section 52 of central discharge tube 9. As shown in FIGS. 5*b* and 5*c*, upper tube section 51 includes a beveled end wall 51*a*, and lower tube section 52 also includes a beveled end wall 52*a*. Upper tube section 51 and lower tube section 52 are both threaded externally to rigidly connect to a shuttle housing 56, although other methods of connecting the tube sections to shuttle housing 56 can be used as is known in the art. Accordingly, shuttle housing 56 is threaded on its interior surface for attachment to upper tube section 51 and lower tube section 52. When upper tube section 51, shuttle housing 56, and lower tube section 52 are connected they effectively combine to form continuous central discharge tube 9. Shuttle housing 56 is generally annular and comprises a fixed piston comprising an annular flange 56*a* protruding between a plurality of upper intake apertures 57 and lower intake apertures 58 defined by shuttle housing 56. Flange 56*a* must extend far enough to slidably and sealably engage the interior wall of a pumping chamber so that it creates an upper sub-chamber and a lower sub-chamber. Upper intake apertures 57 facilitate fluid communication between the upper sub-chamber and central discharge tube 9. Lower intake apertures 58 facilitate fluid communication between the lower sub-chamber and central discharge tube 9. Disposed slidably within shuttle housing 56 is a shuttle member comprising an upper shuttle section 53, an outwardly biased spring 55, and a lower shuttle section 54. Upper shuttle section 53 is also annular and has an upper beveled end wall 53*a* that compliments beveled end wall 51*a* and extends slightly into upper intake apertures 57. Lower shuttle section 54 is also annular and has a lower beveled end wall 54*a* that compliments beveled end wall 52*a* and extends slightly into lower intake apertures 58. Because beveled end walls 53*a* and 54*a* extend slightly into intake apertures 57 and 58, pressure from the fluid in the sub-chambers will force the shuttle member to translate. Spring 55 is disposed in and between upper shuttle section 53 and lower shuttle section 54 as shown in FIG. 5*b*.

Upper and lower shuttle sections 53 and 54 translate between three positions. In the first position, when the central discharge tube 9 is stationary, spring 55 forces upper shuttle section 53 to engage upper tube section 51 and lower shuttle section 54 to engage lower tube section 52, as illustrated in FIG. 5*b*. In this first position, both the upper and lower intake apertures 57 and 58 are closed. In the second position and as shown in FIG. 5*c*, when the central discharge tube is on a down stroke, upper shuttle section 53 engages upper tube section 51, spring 55 is compressed, and lower shuttle section 54 is positioned adjacent upper shuttle section 53. In this second position, the lower intake apertures 58 are open and the upper intake apertures 57 are closed. In the third position (not shown), when the central discharge tube is on an upstroke, lower shuttle section 54 engages lower tube section 52, spring 55 is compressed, and upper shuttle section 53 is positioned adjacent lower shuttle section 54. In this third position, the lower intake apertures 58 are closed and the upper intake apertures 57 are open. When lower intake apertures 58 are open, the central discharge tube 9 is in fluid communication with a lower sub-chamber 12*b* of the pump. When upper intake apertures 57 are open, the central discharge tube 9 is in fluid communication with an upper sub-chamber 12*a* of the pump. The pump operates as described with respect to FIGS. 1*a*-1*c*.

With respect to the shuttle valve assemblies illustrated in FIGS. 4*a*-5*c*, it will be appreciated by persons skilled in the art that equivalent shuttle valve assemblies can position the upper and lower intake apertures on the central discharge tube rather than the shuttle housing with the same effect as long as the shuttle translates between two positions to effectively open or close the apertures as necessary. Similarly, the shuttle can be held in an up position or down position by upper and lower arresting members rather than beveled end walls. Upper and lower arresting members can be pins, flanges, or any other physical means of stopping a shuttle from translating.

Figure 6B:
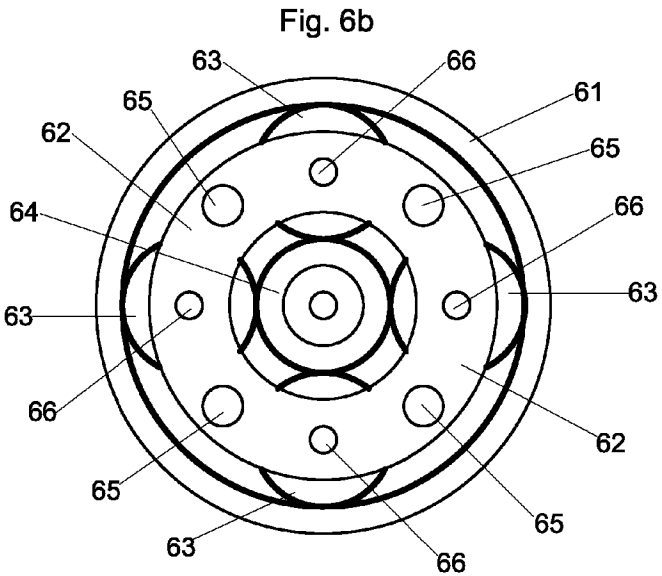
FIG. 6*b* is a top view of the speed reducer.
Figure 6C:
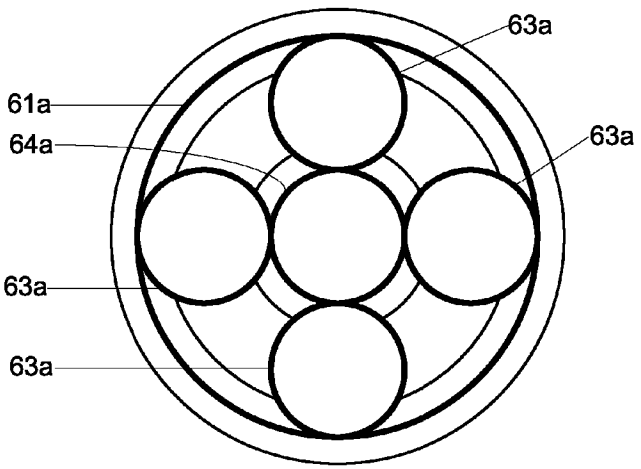
FIG. 6*c* is an alternative top view of the speed reducer.
Figure 6A:
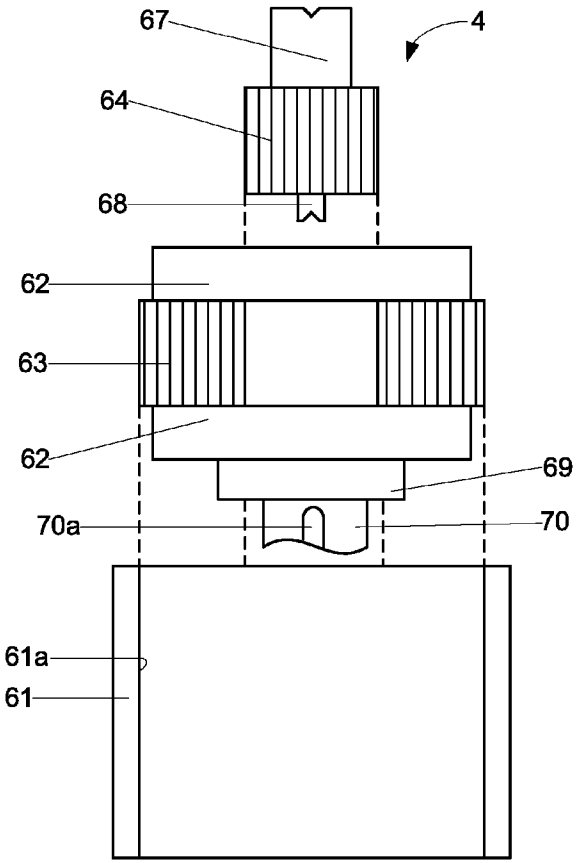
FIG. 6*a* is an exploded view of a speed reducer for use with the preferred embodiment of the pumping system.

FIGS. 6*a*-6*c* illustrate a speed reducer for use with the preferred embodiment of this invention. Speed reducer 4 comprises several stages of planetary reduction gears, however only one stage is illustrated in the drawings. Three stages of planetary reduction gears are preferred. As shown in FIG. 6*a*, speed reducer comprises a housing 61 having an interior wall 61*a* defining gear teeth (not shown). Preferably, interior wall 61 comprises 270 teeth. Housing 61 surrounds a plurality of intermediate gears 63 situated in an intermediate housing 62. Each intermediate gear 63 has an external wall defining gear teeth (not shown). Preferably each intermediate gear 63 comprises 90 teeth. The gear teeth of intermediate gears 63 cooperate with the gear teeth of housing 61. Intermediate housing 62 surrounds and cooperates with a central gear 64. Central gear 64 is not attached to intermediate housing 62 but has an external wall 64*a* (not shown) defining gear teeth that cooperate with the gear teeth of intermediate gears 63. Preferably central gear 64 comprises 90 teeth. Central gear 64 also includes an upper connector 67 for connecting with motor 2 and a bearing stem 68. Intermediate housing 62 includes a lower connector 69 for connecting with the upper connector 67 of an additional stage of planetary reduction gears. On the stage that connects to motion converter 5, lower connector 69 connects to a power output shaft 70 with one ore more flutes 70*a*. Lower connector 69 is shown in FIG. 6*a*, but if multiple states of planetary reduction gears are used, it will only be present on the stage that connects to motion converter 5. Preferably, the nominal speed of motor 2 is 1800 rpm and speed reducer 4 is configured to effect a twenty-seven-to-one reduction for an output of approximately 66 rpm. The output of speed reducer 4 is applied to the input (not shown) of motion converter 5. The number of stages of planetary reduction gears and the number of teeth on the gears and housing can vary depending on what output speed is desired, as will be apparent to someone skilled in the art. Additionally, the length or height of each stage of planetary gears can vary depending on the output speed and torque. Preferably each stage of planetary gears increases in length from the previous stage of planetary gears to account for increased torque, as will be apparent to someone skilled in the art.

Figure 7B:
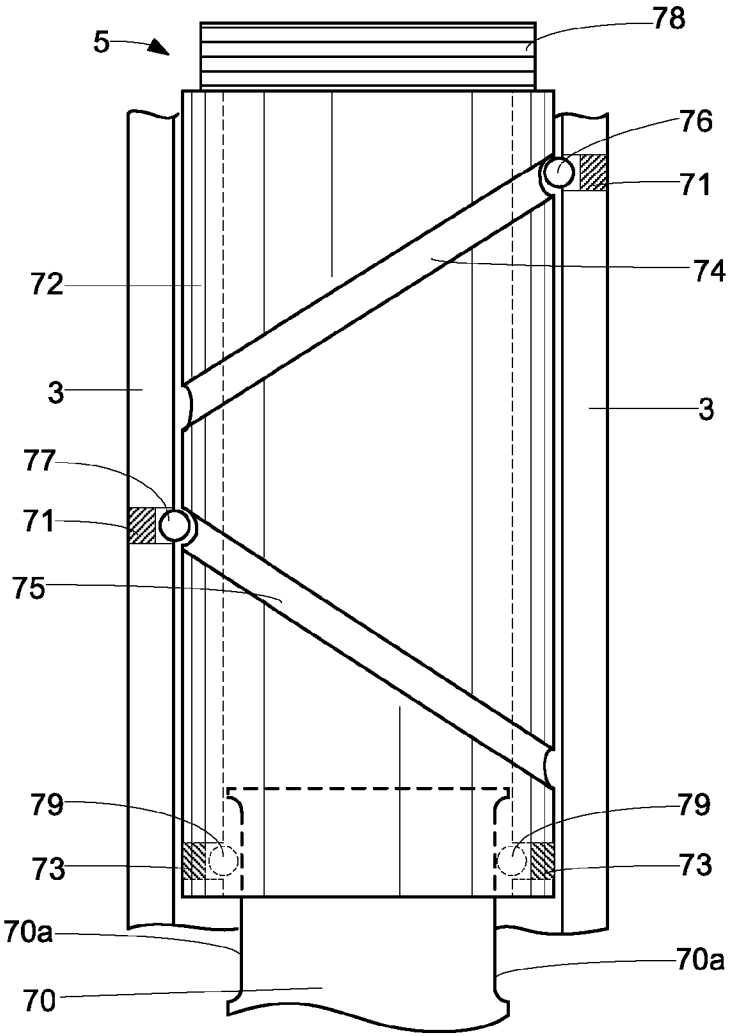
FIG. 7*b* is a partial cutaway view of the rotary-to-reciprocal motion converter.
Figure 7A:
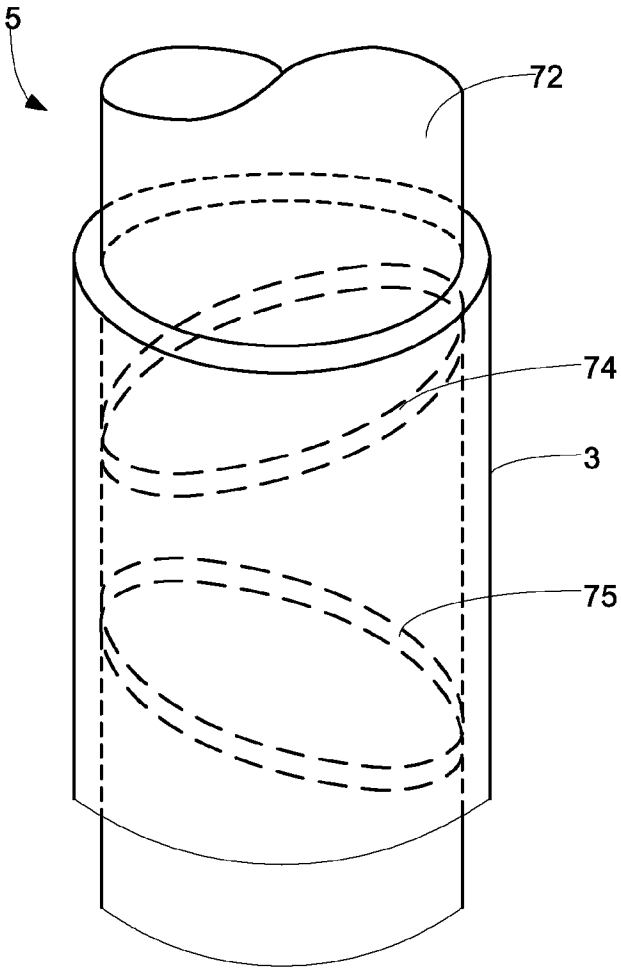
FIG. 7*a* is a perspective view of a rotary-to-reciprocal motion converter for use with the preferred embodiment of the pumping system.

FIGS. 7*a* and 7*b* illustrate a rotary-to-reciprocal motion converter 5 for use with the preferred embodiment of this invention and its cooperation with the power output shaft 70 of speed reducer 4. A cylindrical cam collar 72 surrounds and is coupled to power output shaft 70 of speed reducer 4. Power output shaft 70 of speed reducer 4 comprises flutes 70*a* that cooperates with one or more teeth, protrusions, or bearings 79 extending radially inward to cause cam collar 72 to rotate as power output shaft 70 rotates and to reciprocate along the power output shaft. Bearings 79, for example, can be placed through apertures in cam collar 72 and secured with a plug or cap 73, as shown in FIG. 7*b*. Cam collar 72 is coupled to housing 3 and reciprocates due to its cooperation with housing 3. Cam collar 72 is then directly connected, preferably by threaded connection 78 as shown in FIG. 7*b*, to drive discharge tube 9 (not shown) reciprocally. Cam collar 72 can alternatively be connected to discharge tube 9 using a press fit, bearings, or any other manner of connecting two tubes, as will be apparent to someone skilled in the art. If bearings (not shown) or another connection method that allows central discharge tube 9 to rotate independently of discharge tube 9 are used, central discharge tube 9 can be further constrained against rotary movement by alignment grooves 10 and pins 11 as previously described with respect to FIG. 1*a*. As explained above, the alignment block can be located anywhere along the central discharge tube 9. Furthermore, bearings (not shown) can also be incorporated between housing 3 and cam collar 72 or central discharge tube 9 if necessary.

Cam collar 72 includes at least one elliptical groove in its outer wall obtained by machining a groove in a plane disposed at an angle with respect to the axis of the cam collar. Preferably, two or more such grooves are provided to obtain a more even distribution of the sliding pressures set up between the various mutually moving parts of motion converter 5. As shown in FIGS. 7*a* and 7*b*, a first groove 74 is oriented in a vertical mirror image from a second groove 75. First and second cam follower bearings 76 and 77 respectively extend in diametrically opposite directions into first and second grooves 74 and 75 respectively, which function as cams to drive the bearings. Bearings 76 and 77 can be placed through apertures in housing 3 and secured with caps 71. Those skilled in the art will appreciate that additional bearings and elliptical grooves in the cam collar can be provided to insure the load capacity of motion converter 5 and further spread the load for increased reliability.

As cam collar 72 rotates (in either direction), bearings 76 and 77 must follow grooves 74 and 75. Consequently, cam collar 72 is driven longitudinally by the action of bearings 76 and 77 as they follow grooves 74 and 75. Accordingly, the bottom position of the cam collar 72 and the attached central discharge tube 9 has been reached when bearings 76 and 77 are situated at the respective highest positions of grooves 74 and 75. As the cam collar rotates through 180 degrees, the top position of the cam collar 72 and attached central discharge tube 9 is reached when pins 76 and 77 are in their lowest positions in grooves 74 and 75. At intermediate positions, pins 76 and 77 will be at correspondingly intermediate positions in grooves 74 and 75, and cam collar 72 and connected central discharge tube 9 will be at an intermediate position during an upstroke or downstroke. The output of motion converter 5 preferably reciprocates upwardly and downwardly at a rate of one full cycle per second and is connected to a central discharge tube 9 of pump 6. While a particular cam collar arrangement has been described for converting rotary motion to reciprocal motion, someone skilled in the art will appreciate that alternative designs of a cam collar arrangement as well as alternative methods of converting rotary motion to reciprocal motion can be substituted.

Figure 8A:
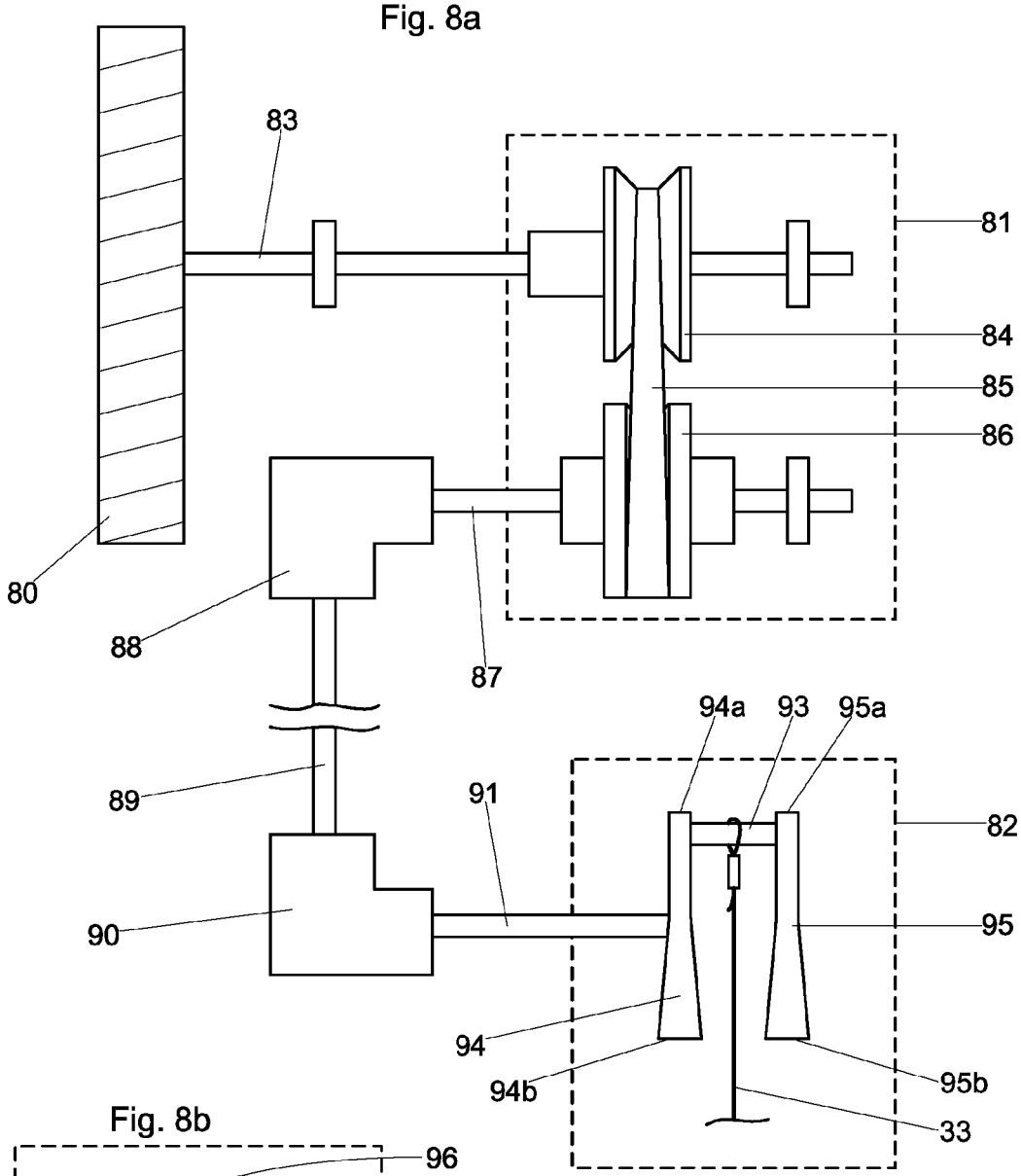
FIG. 8*a* is a side view of a windmill operating a single pump.
Figure 8B:
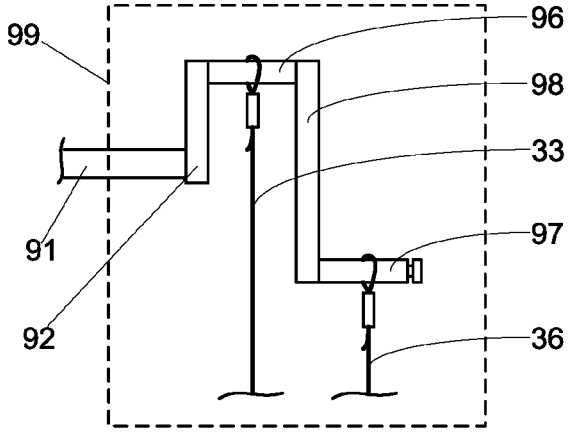
FIG. 8*b* is a side view of a windmill operating two alternating pumps.

FIGS. 8*a* and 8*b* illustrate a drive system comprising a windmill, continuously variable transmission, and counterbalance. This drive system is preferred for use with the alternate embodiment of pump 34 as described with reference to FIGS. 2*a*-2*d*. As shown in FIG. 8*a*, a windmill fan 80 comprising a hub (not shown) and a plurality of outwardly extending rotors (not shown) is coupled to a windshaft 83. Windshaft 83 is coupled to a continuously varying transmission 81 comprising a first spool member 84 and second spool member 86 operably connected with a continuous drivebelt 85. Second spool member 86 is coupled to a first gear box 88 with a laterally extending first drive shaft 87. First gear box 88 is then coupled to a second gear box 90 with a downwardly extending axle 89. Second gear box 90 is then coupled to a rotational counterbalance 82 with a laterally extending second drive shaft 91. In operation, when wind impacts the windmill fan 80, it rotates. Consequently, windshaft 83 then rotates and causes first spool member 84 to rotate. As first spool member 84 rotates, drive belt 85 is forced to rotate, which correspondingly causes second spool member 86 to rotate. Second spool member 86 then causes first drive shaft 87 to rotate, and the conventional gears housed within first gear box 88 actuate and cause axle 89 to rotate. Axel 89 then causes the conventional gears housed within second gear box 90 to actuate and cause second drive shaft 91 to rotate. Drive shaft 91 then causes counterbalance 82 to rotate.

Counterbalance 82 comprises a first weighted element 94 and a second weighted element 95 disposed in spaced apart relation defining substantially parallel planes and being coupled together proximate to respective upper ends 94*a* and 95*a* by means of an elongate pin 93. First weighted element 94 connects at its center to drive shaft 91 in a fixed manner so that as drive shaft 91 rotates, weighted element 94 and weighted element 95 rotate as well. Weighted elements 94 and 95 comprise weighted lower blade portions 94*b* and 95*b* respectively that provide the rotational counterbalance for the pump 34 (not shown). The central discharge tube of pump 34 is secured to pin 93 with string 33, and as weighted elements 94 and 95 rotate, string 33 reciprocates to operate pump 34 as described with reference to FIGS. 2*a*-2*d*. Rotational counterbalance 82 can be of a weight equal to the weight of the mechanical elements of pump 34 that are suspended from pin 93 plus one-half of the head pressure, which is the weight of fluid that bears down on central discharge tube 9 as described with respect to FIG. 2*a*. Preferably, rotational counterbalance 82 is of a weight equal to the weight of the mechanical elements of the suspended pump plus 90% of the head pressure.

As an alternative to counterbalance 82, a cooperative dual pump arrangement 99 can be used to reduce head pressure, as shown in FIG. 8*b*. The cooperative dual pump arrangement comprises a second pump 35 that operates alongside first pump 34 so that the drive system reciprocates string 33 of first pump 34 and string 36 of pump 35. First and second pumps 34 and 35 can be positioned in the same well bore or in separate well bores. The central discharge tubes of first pump 34 and second pump 35, which are suspended with strings 33 and 36 respectively, reciprocate in an alternative fashion. For example, as first string 33 is raised, second string 36 is lowered and as first string 33 is lowered, second string 36 is raised. FIG. 8*b* illustrates a first arm 92 that at its proximate end is radially extending from and coupled to drive shaft 91. Distal end of first arm 92 is coupled to the proximal end of a pin 96 extending parallel to drive shaft 91. The distal end of pin 96 is coupled to the proximate end of a second arm 98. Second arm 98 is parallel to first arm 92 and twice as long as first arm 92. The distal end of second arm 98 is coupled to the proximal end of a second pin 97. In this embodiment, first string 33 is secured to first pin 96, and second string 36 is secured to second pin 97. Accordingly, as drive shaft 91 rotates, strings 33 and 36 reciprocate alternatively. Alternative assemblies for supporting strings 33 and 36 such as a pulley arrangement can be used, as is known in the art, as long as the strings reciprocate alternately. If pumps 34 and 35 are placed at the same depth, by operating both pumps as described, the head pressure above each pump's central discharge tube will be substantially reduced. As an alternative to the dual pump arrangement described with respect to FIG. 8*b*, a reciprocal driveshaft and rocker arm system can be used.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A positive displacement pump system comprising:

a) a drive system comprising a windmill and a counterbalance assembly, the windmill being coupled to the counterbalance assembly via a gearbox assembly;

b) a first pump configured to pump liquid from a deep well, the first pump comprising:

i. two or more vertically aligned pumping chambers;

ii. a reciprocating central discharge tube suspended from the counterbalance assembly, wherein the discharge tube extends through the pumping chambers and is in fluid communication with each pumping chamber; and iii. a valve assembly in each pumping chamber, the valve assembly comprising a piston which sealably and slidably surrounds the central discharge tube and separates each chamber into an upper sub-chamber and lower sub-chamber; and c) a second pump comprising:

i. two or more vertically aligned pumping chambers;

ii. a reciprocating central discharge tube suspended from the counterbalance assembly and extending through the pumping chambers and being in fluid communication with each pumping chamber; and iii. a valve assembly comprising a piston in each pumping chamber that surrounds the central discharge tube and separates each chamber into an upper sub-chamber and lower sub-chamber;

wherein both first and second pumps are controlled and operated by the drive system and the discharge tubes are configured in such a way that the discharge tube of the first pump reciprocates in opposite direction to the reciprocation direction of the central discharge tube of the second pump.

* * * * *